US012503828B2

(12) United States Patent
Hou et al.

(10) Patent No.: US 12,503,828 B2
(45) Date of Patent: Dec. 23, 2025

(54) ROTARY FRAME AND GRADER WITH SAME

(71) Applicant: JIANGSU XCMG CONSTRUCTION MACHINERY RESEARCH INSTITUTE LTD., Jiangsu (CN)

(72) Inventors: Penglong Hou, Jiangsu (CN); Le Gao, Jiangsu (CN); Hongfeng Ma, Jiangsu (CN); Junjie Duan, Jiangsu (CN)

(73) Assignee: JIANGSU XCMG CONSTRUCTION MACHINERY RESEARCH INSTITUTE LTD., Xuzhou (CN)

( * ) Notice: Subject to any disclaimer, the term of this patent is extended or adjusted under 35 U.S.C. 154(b) by 1050 days.

(21) Appl. No.: 17/545,380

(22) Filed: Dec. 8, 2021

(65) Prior Publication Data

US 2023/0106191 A1 Apr. 6, 2023

(30) Foreign Application Priority Data

Sep. 1, 2021 (CN) ..... 202111020595.3

(51) Int. Cl.
*E02F 3/76* (2006.01)
*E02F 3/84* (2006.01)

(52) U.S. Cl.
CPC ..... *E02F 3/764* (2013.01); *E02F 3/7645* (2013.01); *E02F 3/844* (2013.01)

(58) Field of Classification Search
CPC ..... E02F 3/815; E02F 3/7636; E02F 3/844
See application file for complete search history.

(56) References Cited

U.S. PATENT DOCUMENTS 3,465,829 A * 9/1969 Mccarthy ..... A01B 31/00 172/795
6,585,059 B2 * 7/2003 Michael, Jr. ..... E02F 3/815 172/811
7,650,949 B1 * 1/2010 Horstman ..... E02F 3/7677 172/795

FOREIGN PATENT DOCUMENTS

| | | | |
|---|---|---|---|
| CA | 1095237 | A | 2/1981 |
| CN | 203668990 | U | 6/2014 |
| CN | 106351278 | A | 1/2017 |
| CN | 206015752 | U | 3/2017 |
| CN | 108603356 | A | 9/2018 |
| CN | 209144890 | U | 7/2019 |

(Continued)

*Primary Examiner* — Joseph M Rocca
*Assistant Examiner* — Ashley A Kaercher
(74) *Attorney, Agent, or Firm* — Myers Bigel, P.A.

(57) ABSTRACT

A rotary frame includes a first connecting member of the rotary frame has an arc-shaped concave part. Each second connecting member is non-coplanar with the first connecting member and has a mounting hole. A first reinforcing member is connected between a first end of the first connecting member and one of the second connecting members; and another first reinforcing member is connected between a second end of the first connecting member and the other second connecting member. A second reinforcing member is connected between a middle part of a circumferential edge of the first connecting member and one of the second connecting members; and another second reinforcing member is connected between the middle part of the circumferential edge of the first connecting member and the other second connecting member. Middle regions of the first and second reinforcing members joined to the same second connecting member are separate from each other.

13 Claims, 5 Drawing Sheets

(56) References Cited

FOREIGN PATENT DOCUMENTS

| | | | | |
|---|---|---|---|---|
| CN | 209653007 | U | | 11/2019 |
| CN | 212477861 | U | * | 2/2021 |

* cited by examiner

ROTARY FRAME AND GRADER WITH SAME

CROSS-REFERENCE TO RELATED APPLICATIONS

The present application is based on and claims the priority of Chinese patent application No. 202111020595.3 filed on Sep. 1, 2021, the disclosure of which is incorporated herein by reference in its entirety.

FIELD OF THE INVENTION

The present disclosure relates to the field of graders, in particular to a rotary frame and a grader.

DESCRIPTION OF RELATED ART

A grader is the machine used for shaping and leveling operations in the earthwork. The grader is also an essential piece of equipment in national defense engineering, mine construction, road construction, water conservancy construction, farmland improvement, etc. The reason why the grader assists operations in such a wide range of scenarios is closely related to the fact that the grader's blade rotates 360 degrees, and a soil-cutting angle of the blade is adjusted in real time according to the working environment. A rotary frame of the grader is the main load-bearing structure to realize the above functions, so that the lifetime of the rotary frame directly determines the service life of the whole grader. In recent years, with the working performance of graders being continuously improved, the tonnage of graders has been continuously increasing, resulting in a corresponding increase in blade length and load. However, the bending strength of the rotary frame is insufficient, so that the rotary frame is prone to damage, which affects the service life of the whole grader.

The inventors have found that there are at least the following problems in the prior art. There is obvious stress concentration in the bends of the rotary frames currently used by graders. When the graders work under heavy loads, the rotary frames are subjected to great bending moments and, therefore, are prone to damage. In order to solve this problem, the thickness and width of the bends need to be increased, but this cause an overweight of the rotary frames, which in turn overload the graders.

SUMMARY OF THE INVENTION

The present disclosure provides a rotary frame and a grader and is intended to improve the bearing capacity of a rotary frame while realizing a lightweight construction of the rotary frame.

Some embodiments of the present disclosure provide a rotary frame, comprising:

a first connecting member having an arc-shaped concave part, wherein the concave part is configured to be open-ended in its circumferential direction, and a body of the concave part comprises a first open edge and a second open edge;

two second connecting members, wherein both of the second connecting members are non-coplanar with the first connecting member, and each second connecting member is provided with a mounting hole;

two first reinforcing members, wherein one of the first reinforcing members is connected between the first end of the first connecting member and one of the second connecting members, and the other first reinforcing member is connected between the second end of the first connecting member and the other second connecting member; and two second reinforcing members, one of the second reinforcing members being connected between a middle part of a circumferential edge of the first connecting member and one of the second connecting members, and the other second reinforcing member being connected between the middle part of the circumferential edge of the first connecting member and the other second connecting member, wherein at least middle regions of the first reinforcing member and the second reinforcing member, respectively, joined to the same second connecting member are separate from each other.

In some embodiments, the two second connecting members are arranged symmetrically about a central axial plane of the first connecting member.

In some embodiments, the two first reinforcing members are arranged symmetrically about a central axial plane of the first connecting member.

In some embodiments, the two second reinforcing members are arranged symmetrically about a central axial plane of the first connecting member.

In some embodiments, the first reinforcing members are both configured to be bent, and the two first reinforcing members are both convex toward the second reinforcing members.

In some embodiments, the two second reinforcing members are configured as a unitary piece, and a smooth concave surface is formed at a joint of the two second reinforcing members.

In some embodiments, one end of the first reinforcing member and one end of the second reinforcing member are fixedly joined to each other with a smooth transition at the joint, and said one end of the first reinforcing member and one end of the second reinforcing member are both joined to the same second connecting member.

In some embodiments, the first connecting member, together with the first reinforcing member and the second reinforcing member which are fixedly joined to the same second connecting member, confines a weight reducing through-hole.

In some embodiments, the first connecting member is configured as a plate;

and/or the second connecting member is configured as a beam; and/or the first reinforcing member is configured as a rib; and/or the second reinforcing member is configured as a rib.

In some embodiments, the first connecting member, the two second connecting members, the two first reinforcing members and the two second reinforcing members are integrally configured as a unitary piece.

Some embodiments of the present disclosure provides a grader, which comprises the rotary frame provided by any of the technical schemes of the present disclosure.

In some embodiments, the grader further comprises:

a rotary ring mounted to the concave part of the first connecting member of the rotary frame, an outer peripheral surface of the rotary ring conforming to an inner wall of the concave part.

In some embodiments, the grader further comprises:

two angular position adjusting members, each of which is rotatably mounted in the mounting hole of one of the first connecting members;

a blade slidably mounted to the two angular position adjusting members; and two cylinders, wherein one of the cylinders is mounted between the rotary ring and one of the angular position adjusting members, and the other cylinder is mounted between the rotary ring and the other angular position adjuster.

The rotary frame provided by the above technical scheme comprises a first connecting member, two second connecting members, two first reinforcing members and two second reinforcing members. The first reinforcing members and the second reinforcing members not only play a role in connecting the first connecting member and the second connecting members, but also play a role in strengthening the structural stability of the rotary frame. In addition, there are gaps between the first reinforcing members and the second reinforcing members, and the gaps are relatively large, which is beneficial to improvement of the bending moment resistance of the rotary frame against the load in a forward direction of the blade and has little influence on the weight of the rotary frame. According to the technical scheme above, the bending resistance of the structure is ensured, and the structural lightening is also facilitated, so that the requirements for increasing the strength and lightening the weight of the rotary frame are well balanced.

BRIEF DESCRIPTION OF THE DRAWINGS

The accompanying drawings described here are used to provide a further understanding of the present disclosure and constitute a part of the present application. The illustrative embodiments of the present disclosure and their descriptions are used to explain the present disclosure, and do not constitute an improper limitation to the present disclosure. In the accompanying drawings.

DESCRIPTION OF THE INVENTION

Figure 1:
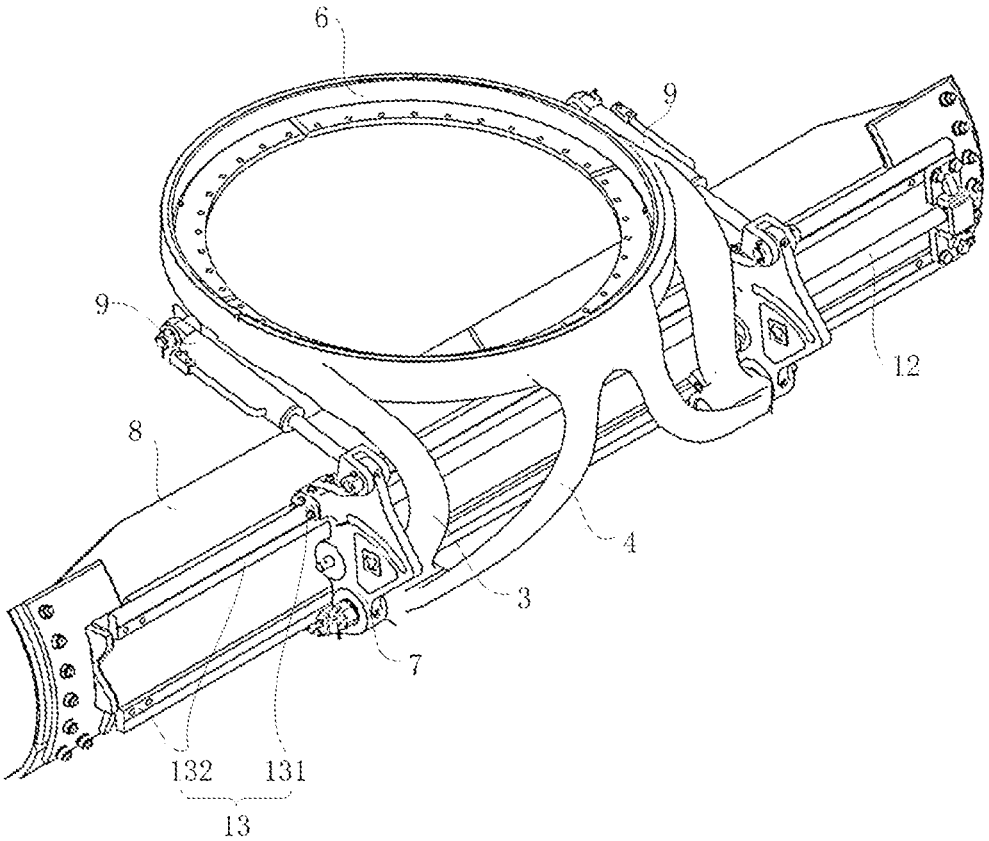
FIG. 1 is an assembly drawing of a rotary frame mounted to a grader according to some embodiments of the present disclosure.

The technical scheme provided by the present disclosure will be described in more detail below with reference to FIGS. 1-5.

The inventors have found that in the prior art, the structures of rotary frames are generally sickle-shaped, and stress concentration at the bends of such rotary frames is obvious. When the graders work under heavy loads, the rotary frames are subjected to great bending moments. If the strength of the rotary frames is to be improved by increasing the size of the bends, such as increasing the width and thickness of a bent plate or adding local reinforcing structures such as reinforcing ribs at the bends of the rotary frames, the strength of the rotary frame will be improved, but the weight of the rotary frames will also increase, which is not conducive to the lightweight construction of the rotary frames. Adding reinforcing ribs and other local reinforcing structures at the bends of the rotary frames will increase the weight of the rotary frames and increase the number of welds, and stress concentration often occurs at the welds, which will adversely affect the structural strength. In order to solve the above problems, the inventors propose a rotary frame and a grader provided by the following particular embodiments.

Some embodiments of the present disclosure provide a rotary frame, which comprises a first connecting member 1, two second connecting members 2, two first reinforcing members 3 and two second reinforcing members 4. The two first reinforcing members 3 are designated as the first reinforcing member 3*a* and the first reinforcing member 3*b*, respectively. The two second reinforcing members 4 are designated as the second reinforcing member 4*a* and the second reinforcing member 4*b*, respectively. The first connecting member 1 has an arc-shaped concave part 11. The concave part 11 is configured to be open-ended in its circumferential direction. The concave part 11 comprises a first end 11*a* and a second end 11*b*. Each second connecting member 2 is non-coplanar with the first connecting member 1. Each second connecting member 2 is provided with a mounting hole 21. One of the first reinforcing members 3(the first reinforcing member 3*a*) is connected between the first end 11*a* of the first connecting member 1 and one of the second connecting members 2(the second connecting member 2*a*); and another first reinforcing member 3(the first reinforcing member 3*b*) is connected between a second end 11*b* of the first connecting member 1 and the other second connecting member 2(the second connecting member 2*b*). One of the second reinforcing members 4(the second reinforcing member 4*a*) is connected between a middle part of a circumferential edge of the first connecting member 1 and one of the second connecting members 2(the second connecting member 2*a*); and the other second reinforcing member 4(the second reinforcing member 4*b*) is connected between the middle part of the circumferential edge of the first connecting member 1 and the other second connecting member 2 (the second connecting member 2*b*). At least the middle regions of the first reinforcing member 3 and the second reinforcing member 4, respectively, joined to the same second connecting member 2 are separate from each other.

The rotary frame is configured as a symmetrical structure which is symmetrical about a central axial plane A of the first connecting member 1. Here, the position of the central axial plane A of the first connecting member 1 is schematically shown at the plane in FIG. 1 and FIG. 3. In the state of the rotary frame is installed onto the grader, the center of the rotary ring 6 coincides with the center of the first connecting member 1, such that the two are fixedly installed to each other. Therefore, the central axial plane A of the first connecting member 1 is defined with reference to the rotary ring 6.

The first connecting member 1 and the second connecting members 2 of the rotary frame are in different planes, and the rotary frame is a three-dimensional structure. The two first reinforcing members 3 and the two second reinforcing members 4 serve to connect the first connecting member 1 and the second connecting members 2 and enhance the strength and bearing capacity of the rotary frame.

Figure 2:
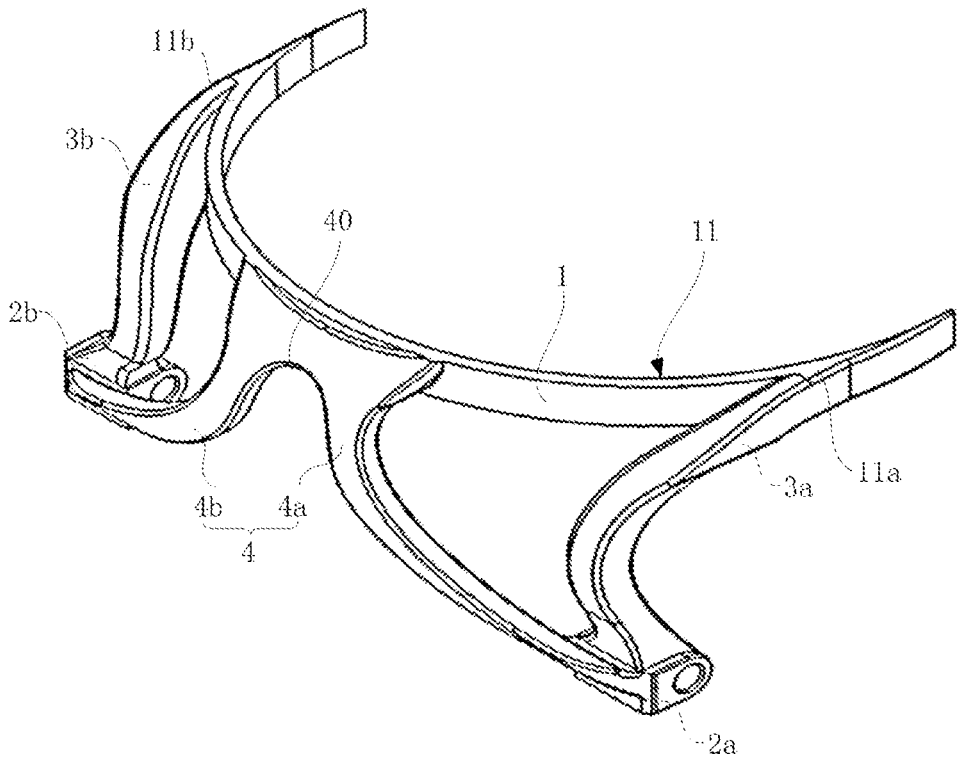
FIG. 2 is a perspective view of the rotary frame according to some embodiments of the present disclosure.

Referring to FIG. 2, in some embodiments, the first connecting member 1 is configured as a curved plate; and/or the second connecting member 2 is configured as a beam; and/or the first reinforcing member 3 is configured as a rib; and/or the second reinforcing member 4 is configured as a rib.

Referring to FIG. 2, in some embodiments, the first connecting member 1 itself is also symmetrical about its own central axial plane A. The first connecting member 1 is approximately a half ring. With such a structure, the rotary ring 6 is easily installed in the concave part 11 of the first connecting member 1.

Figure 3:
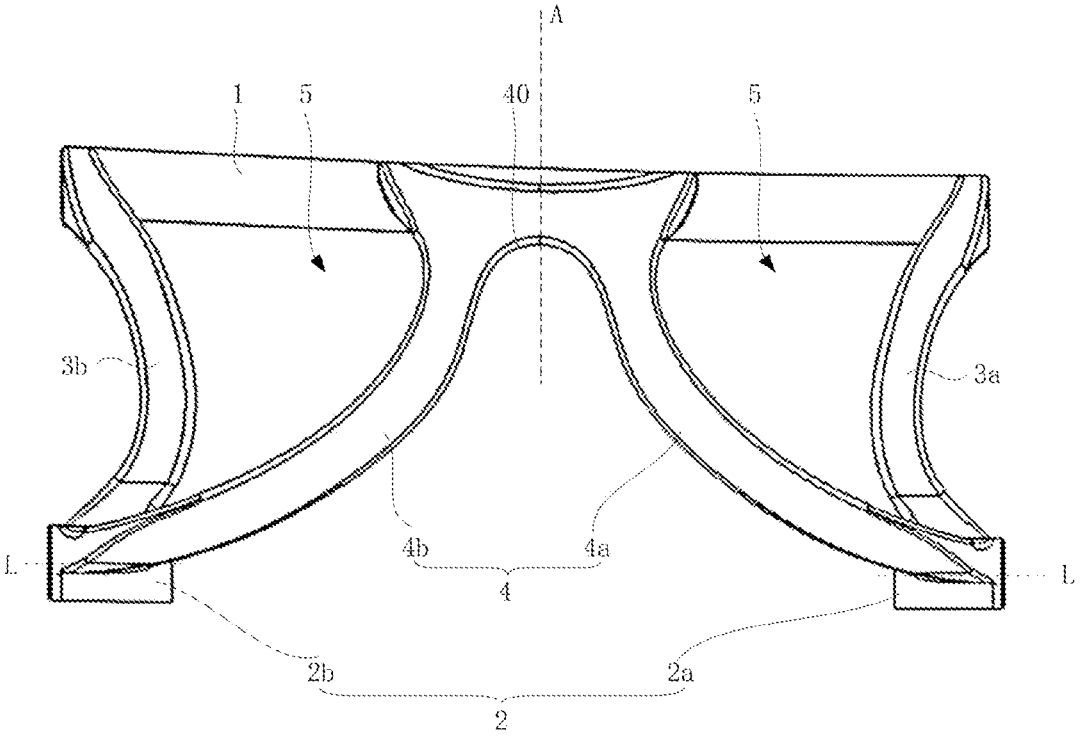
FIG. 3 is a front view of the rotary frame according to some embodiments of the present disclosure.

Referring to FIGS. 2 and 3, each second connecting member 2 is provided with a mounting hole 21. Take the direction shown in Fi. 3 as an example, an axis L of the mounting hole 21 extends horizontally. This axis L is an axis of rotation of an angular position adjuster 7, which will be described later, relative to the rotary frame.

Referring to FIG. 2, in some embodiments, the two second connecting members 2 are arranged symmetrically about the central axial plane A of the first connecting member 1.

With continued reference to FIG. 2, the two first reinforcing members 3 are both arranged outside the first connecting member 1 to support and fix the first connecting member 1 from the outside of the first connecting member 1. One of the first reinforcing members 3 fixes and supports the first end 11*a* of the first connecting member 1, while the other first reinforcing member 3 fixes and supports the second end 11*b* of the first connecting member 1. Thus, the two first reinforcing members 3 provide support at a plurality of positions in the circumferential direction of the first connecting member 1.

Referring to FIGS. 2-5, in some embodiments, the two first reinforcing members 3 are arranged symmetrically about the central axial plane A of the first connecting member 1. The two first reinforcing members 3 are symmetrical to each other in structure. Each of the first reinforcing members 3 is a bent beam.

As seen from the front view in FIG. 3, the projection of each first reinforcing member 3 is arc-shaped. Referring to FIG. 3, the first reinforcing members 3 are both configured to be bent, and the first reinforcing members 3 are both convex toward the second reinforcing members 4, respectively. As seen from the left view in FIG. 4, the projection of each first reinforcing member 3 is also arc-shaped. As seen from the top view in FIG. 5, the projection of each first reinforcing member 3 is still arc-shaped. In the three views, the shapes of the arcs are different.

As seen from the front view shown in FIG. 3, each first reinforcing member 3 does not exceed the rectangular frame defined by the first connecting member 1 and the two second connecting members 2. In addition, the curved parts of the two first reinforcing members 3 are convex toward each other, instead of being bent outwards, so that the structure of the rotary frame is more compact. As seen from the left view in FIG. 4, the projections of the two first reinforcing members 3 coincide. Projections of the two first reinforcing members 3 and the two second reinforcing members 4 are staggered to reinforce the first connecting member 1 at two different positions, so that the structure of the rotary frame is more stable. As seen from the top view in FIG. 5, the first reinforcing member 3 and the second reinforcing member 4 on each side of the central axial plane A of the first connecting member 1 and the half of the first connecting member 1 on this side generally form a triangular structure, although the three sides of the triangle are all arc-shaped. The middle of the triangle is hollow, namely, the first connecting member 1, together with the first reinforcing member 3 and the second reinforcing member 4 which are fixedly joined to the same second connecting member 2, confines a weight reducing through-hole 5. The weight reducing through-hole 5 makes the weight of the rotary frame lighter. The generally triangular structure effectively increases the stability of the rotary frame and greatly enhances the bearing capacity of the rotary frame.

With continued reference to FIGS. 2-5, in some embodiments, the two second reinforcing members 4 are arranged symmetrically about the central axial plane A of the first connecting member 1. As seen from the front view in FIG. 3, the projection of each second reinforcing member 4 is arc-shaped. As seen from the left view in FIG. 4, the projection of each second reinforcing member 4 is also arc-shaped. As seen from the top view in FIG. 5, the projection of each second reinforcing member 4 is still arc-shaped. In the three views, the shapes of the arcs are different.

As seen from the angle of view in FIG. 3, the two second reinforcing members 4 are located on the inner side of the two first reinforcing members 3. The rotary frame generally forms two triangular structures. The second reinforcing members 4 of the two triangles are fixedly joined to each other. The two second reinforcing members 4 generally form a splayed structure.

Referring to FIG. 3, in some embodiments, the two second reinforcing members 4 are configured as a unitary piece, and a smooth concave surface 40 is formed at the joint of the two second reinforcing members 4. The convex direction of the concave surface 40 is different from that of the first connecting member 1. There is a large empty area outside the two second reinforcing members 4, and there is no structure in this area, so the structure of the rotary frame is more in line with the requirements of lightweight. Moreover, the two triangular structures have very strong bearing capacity.

Figure 4:
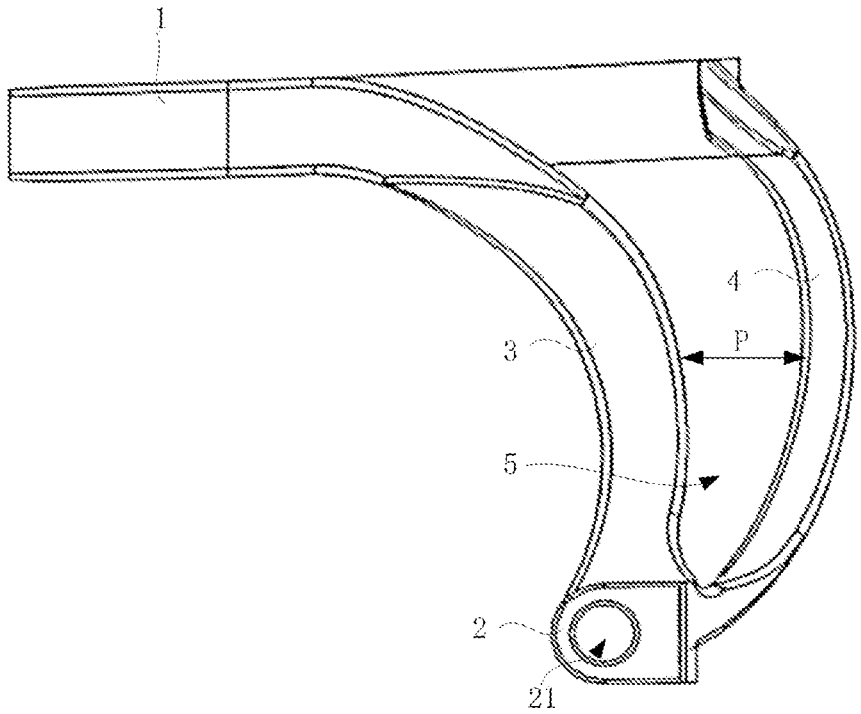
FIG. 4 is a left view of the rotary frame according to some embodiments of the present disclosure.
Figure 5:
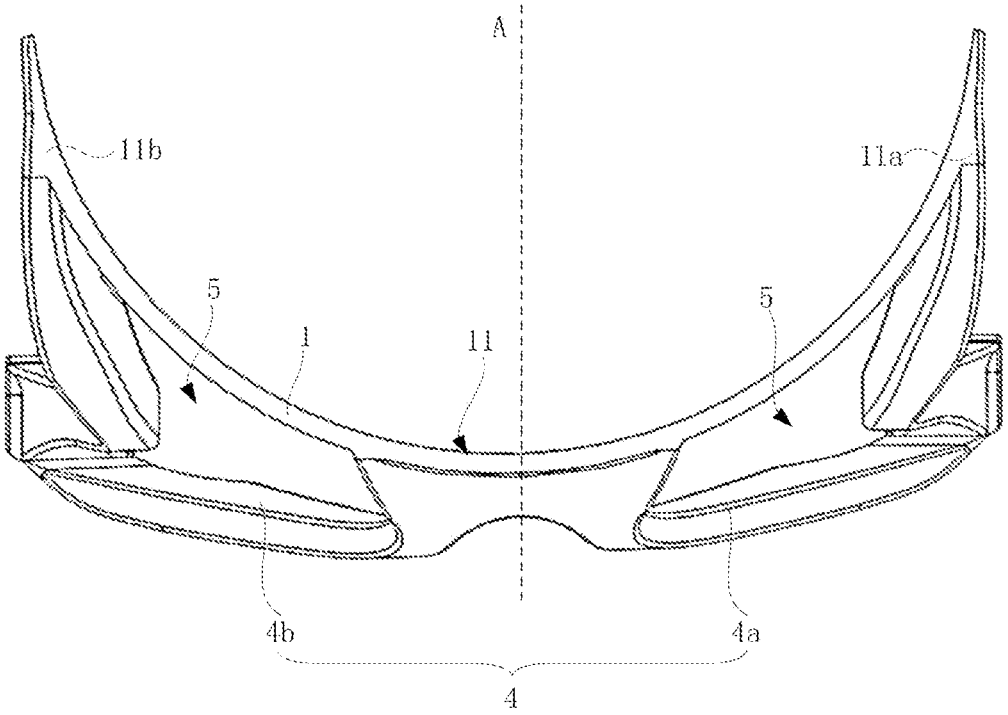
FIG. 5 is a top view of the rotary frame according to some embodiments of the present disclosure.

Referring to FIG. 4, when seen from the left view, at least middle regions of the first reinforcing member 3 and the second reinforcing member 4, respectively, joined to the same second connecting member 2 are separate from each other. Joined to the second connecting member 2*a* are the first reinforcing member 3*a* and the second reinforcing member 4*a*. The first reinforcing member 3*a* and the second reinforcing member 4*a* both have one end fixedly joined to the second connecting member 2*a* and the other end fixedly joined to the first connecting member 1. The other end of the first reinforcing member 3*a* and the other end of the second reinforcing member 4*a* are separate from each other, which makes the first reinforcing member 3*a* and the second reinforcing member 4*a* have a gap P therebetween except the parts joined to the second connecting member 2*a*. The gap affects the bending resistance of the rotary frame. Seen from the direction in FIG. 4, within a certain limit, the larger the gap P is, the stronger the bending resistance of the rotary frame is. On the contrary, the smaller the gap P is, the weaker the bending resistance of the rotary frame is.

Joined to the second connecting member 2*b* are the first reinforcing member 3*b* and the second reinforcing member 4*b*. The first reinforcing member 3*b* and the second reinforcing member 4*b* both have one end fixedly joined to the second connecting member 2*b* and the other end fixedly joined to the first connecting member 1. The other end of the first reinforcing member 3*b* and the other end of the second reinforcing member 4*b* are separate from each other, which makes the first reinforcing member 3*b* and the second reinforcing member 4*b* also have a gap P therebetween except the parts joined to the second connecting member 2*b*.

As seen from the left view in FIG. 4, the convex directions of the first reinforcing member 3 and the second reinforcing member 4 are the same. The upper end of the rotary frame is provided with the first connecting member 1, which is relatively long. The lower end of the rotary frame is provided with the second connecting member 2, which is relatively short. Seen from the left view in FIG. 4, the rotary frame is roughly regarded as a triangle, and the upper side is longer. The first connecting member 1 serves as one side, and the first reinforcing member 3 and the second reinforcing member 4 serve as the other two sides. The second connecting member 2 serves as a corner at the bottom.

Referring to FIGS. 2 and 3, in some embodiments, the respective ends, far away from the first connecting member 1, of the first reinforcing member 3 and the second reinforcing member 4 joined to the same second connecting member 2 are fixedly connected to each other with a smooth transition at the joint.

The first connecting member 1, the first reinforcing members 3 and the second reinforcing members 4 are integrally formed, in some embodiments the first reinforcing members 3 and the second reinforcing members 4 are fixed to each other by welding or by connectors such as bolts. The joints between the first reinforcing members 3, the second reinforcing members 4 and the first connecting member 1 are all smooth transitions to reduce stress concentration and improve the bearing capacity of the rotary frame.

The second connecting members 2, the first reinforcing member 3*a*, the first reinforcing member 3*b*, the second reinforcing member 4*a* and the second reinforcing member 4*b* are integrally formed. In some embodiments, the second connecting members 2, the first reinforcing member 3*a*, the first reinforcing member 3*b*, the second reinforcing member 4*a* and the second reinforcing member 4*b* are fixed to each other by welding or by connectors such as bolts. The joints between the first reinforcing members 3, the second reinforcing members 4 and the second connecting members 2 are also smooth transitions to reduce stress concentration and improve the bearing capacity of the rotary frame.

In some embodiments, the first connecting member 1, the two second connecting members 2, the two first reinforcing members 3 and the two second reinforcing members 4 are integrally configured as a unitary piece. That is, the second connecting members 2, the first reinforcing member 3*a*, the first reinforcing member 3*b*, the second reinforcing member 4*a* and the second reinforcing member 4*b* are integrally formed. The structure of the rotary frame is a stable unitary body with strong bearing capacity.

According to the rotary frame provided by the technical scheme above, a novel layout structure of the rotary frame of the grader is formed by topology optimization design and casting. The structure is not only light in weight, but also has high bending strength, which effectively solves the design contradiction between weight and strength of the structure, and is beneficial to lightening the structure of the rotary frame of the grader and improving the fatigue life of the rotary frame of the grader, thus ensuring the operation safety and reliability of the whole grader.

Some embodiments of the present disclosure further provide a grader, which comprises the rotary frame provided by any of the technical schemes of the present disclosure.

Referring to FIG. 1, in some embodiments, the grader further comprises a rotary ring 6. The rotary ring 6 is mounted to the concave part 11 of the first connecting member 1 of the rotary frame. The rotary ring 6 and the first connecting member 1 are fixed to each other by welding, riveting or by connectors such as bolts. An outer peripheral surface of the rotary ring 6 conforms to an inner wall of the concave part 11. The outer peripheral surface of the rotary ring 6 completely conforms to the inner wall of the concave part 11, which effectively increases the contact area between the rotary ring 6 and the concave part 11, so that the support to the rotary ring 6 is more stable and the stress is more uniformly distributed.

In some embodiments, the grader further comprises two angular position adjusting members 7, a blade 8 and two cylinders 9. Each angular position adjuster 7 is rotatably mounted in a mounting hole 21 of one of the first connecting members 1, and the angular position adjuster 7 is rotatable relative to the rotary frame. Rotation of the angular position adjusting members 7 is driven by the cylinders 9, and each cylinder 9 drives one of the angular position adjusting members 7. One of the two cylinders 9 is mounted between the rotary ring 6 and one of the angular positions adjusting members 7, and the other cylinder 9 is mounted between the rotary ring 6 and the other angular position adjuster 7.

Referring to FIG. 1, in some embodiments, the grader further comprises a driver 12 and guider 13. The driver 12 is in a drive connection with the blade 8 to drive the blade 8 to slide relative to the angular position adjuster 7. The guider 13 comprises a sliding groove 131 and a guide rail 132. The angular position adjusting members 7 are both provided with the sliding groove 131. The guide rail 132 is fixedly joined to the blade 8. The sliding groove 131 cooperates with the guide rail 132. The guide rail 132 is movably installed in the sliding groove 131. The linear sliding movement of the blade 8 is driven by the sliding driver 12, such as a telescopic cylinder. Two sets of sliding grooves 131 and guide rails 132 are provided, and the two sets of guider 13 are parallel to each other, so that the linear movement of the blade 8 is more stable.

In the description of the present disclosure, it should be understood that, descriptions relating to orientation, for example, orientation or positional relationships indicated by "center", "longitudinal", "lateral", "front", "back", "left", "right", "vertical", "horizontal", "top", "bottom", "inside", "outside" etc. are based on the orientation or positional relationships shown in the accompanying drawings, and are to facilitate the description of the present disclosure and simplify the description only, rather than indicating or implying that the device or element referred to must have a specific orientation or be configured and operated in a specific orientation, and therefore cannot be construed as limiting the present disclosure.

Finally, it should be noted that the above embodiments are only used to illustrate the technical schemes of the present disclosure and are not intended to limit the present disclosure. Although the present disclosure has been described in detail with reference to the foregoing embodiments, those of ordinary skill in the art will understand that modifications can be made to the technical schemes described in the aforementioned embodiments, or equivalent replacements can be made to some of the technical features in the embodiments, but these modifications or replacements do not make the essence of the corresponding technical schemes deviate from the spirit and scope of the technical schemes of the embodiments of the present disclosure.

The invention claimed is:

1. A rotary frame, comprising:

a first connecting member having an arc-shaped concave part, wherein the concave part is configured to be open-ended in its circumferential direction, and a body of the concave part comprises a first end and a second end;

two second connecting members, wherein both of the second connecting members are non-coplanar with the first connecting member, and each second connecting member is provided with a mounting hole;

two first reinforcing members, wherein one of the first reinforcing members is connected between the first end of the first connecting member and one of the second connecting members, and the other first reinforcing member is connected between the second end of the first connecting member and the other second connecting member; and two second reinforcing members, one of the second reinforcing members being connected between a middle part of a circumferential edge of the first connecting member and one of the second connecting members, and the other second reinforcing member being connected between the middle part of the circumferential edge of the first connecting member and the other second connecting member, wherein at least middle regions of the first reinforcing member and the second reinforcing member, respectively, connected to the same second connecting member are separate from each other, wherein the first reinforcing members are both configured to be curved, and the two first reinforcing members are both convex toward the second reinforcing members.

2. The rotary frame of claim 1, wherein the two second connecting members are arranged symmetrically about a central axial plane of the first connecting member.

3. The rotary frame of claim 1, wherein the two first reinforcing members are arranged symmetrically about a central axial plane of the first connecting member.

4. The rotary frame of claim 1, wherein the two second reinforcing members are arranged symmetrically about a central axial plane of the first connecting member.

5. The rotary frame of claim 1, wherein the two second reinforcing members are configured as a unitary piece, and a concave surface is formed at a joint of the two second reinforcing members.

6. The rotary frame of claim 1, wherein one end of the first reinforcing member and one end of the second reinforcing member are fixedly joined to each other with a transition at the joint, and said one end of the first reinforcing member and said one end of the second reinforcing member are both joined to the same second connecting member.

7. The rotary frame of claim 1, wherein the first connecting member, together with the first reinforcing member and the second reinforcing member which are fixedly joined to the same second connecting member, confines a weight reducing through-hole.

8. The rotary frame of claim 1, wherein the first connecting member is configured as a curved plate; and/or the second connecting member is configured as a beam; and/or the first reinforcing member is configured as a rib; and/or the second reinforcing member is configured as a rib.

9. The rotary frame of claim 1, wherein the first connecting member, the two second connecting members, the two first reinforcing members and the two second reinforcing members (4) are configured as a unitary piece.

10. A grader comprising the rotary frame of claim 1.

11. The grader of claim 10, further comprising:

a rotary ring mounted to the concave part of the first connecting member of the rotary frame, an outer peripheral surface of the rotary ring conforming to an inner wall of the concave part.

12. The grader of claim 11, further comprising:

two angular position adjusting members, each of which is rotatably mounted in the mounting hole of one of the second connecting members;

a blade slidably mounted to the two angular position adjusting members; and two cylinders, wherein one of the cylinders is mounted between the rotary ring and one of the angular position adjusting members, and the other cylinder is mounted between the rotary ring and the other angular position adjuster.

13. The grader of claim 12, further comprising:

a driver in a drive connection with the blade to drive the blade to slide relative to the angular position adjusting members; and a guider comprising a sliding groove and a guide rail, wherein the angular position adjusting members are both provided with the sliding groove, the guide rail is fixedly joined to the blade, and the sliding groove cooperates with the guide rail.

* * * * *